US011415148B2

(12) United States Patent
Deng et al.

(10) Patent No.: US 11,415,148 B2
(45) Date of Patent: Aug. 16, 2022

(54) VARIABLE DIFFUSER DRIVE SYSTEM

(71) Applicant: Carrier Corporation, Palm Beach Gardens, FL (US)

(72) Inventors: Kai Deng, Shanghai (CN); Vishnu M. Sishtla, Manlius, NY (US)

(73) Assignee: CARRIER CORPORATION, Palm Beach Gardens, FL (US)

( * ) Notice: Subject to any disclaimer, the term of this patent is extended or adjusted under 35 U.S.C. 154(b) by 4 days.

(21) Appl. No.: 17/045,706

(22) PCT Filed: Apr. 9, 2019

(86) PCT No.: PCT/US2019/026559
§ 371 (c)(1),
(2) Date: Oct. 6, 2020

(87) PCT Pub. No.: WO2019/199805
PCT Pub. Date: Oct. 17, 2019

(65) Prior Publication Data

US 2021/0164494 A1 Jun. 3, 2021

(30) Foreign Application Priority Data

Apr. 9, 2018 (CN) ..... 201810314031.2

(51) Int. Cl.
*F04D 29/46* (2006.01)
*F04D 17/10* (2006.01)
(Continued)

(52) U.S. Cl.
CPC ..... *F04D 29/464* (2013.01); *F04D 17/10* (2013.01); *F04D 27/001* (2013.01);
(Continued)

(58) Field of Classification Search
CPC .... F04D 17/10; F04D 27/002; F04D 27/0246; F04D 29/063; F04D 29/464; F05D 2250/90
See application file for complete search history.

(56) References Cited

U.S. PATENT DOCUMENTS 3,365,120 A * 1/1968 Jassniker ..... F04D 29/464 415/26
3,426,964 A 2/1969 Silvern
(Continued)

FOREIGN PATENT DOCUMENTS

EP 0198784 A1 10/1986
JP 2001329996 A 11/2001
WO 2017208685 A1 12/2017

OTHER PUBLICATIONS

International Search Report Application No. PCT/2019/026559; dated Jun. 19, 2019; pp. 6.
(Continued)

*Primary Examiner* — Ninh H. Nguyen
(74) *Attorney, Agent, or Firm* — Cantor Colburn LLP

(57) ABSTRACT

A system is provided and includes a compressor. The compressor further includes a diffuser frame, a gas or oil actuator and a drive system. The diffuser frame defines a first channel through which compressed fluids are flowable, a second channel intersecting the first channel and a third channel extending from the second channel. The gas or oil actuator includes a piston and a head integrally coupled to the piston. The head and the piston are disposable in the second and third channels, respectively. The piston is movable in forward or reverse directions through the third channel such that the head is movable through the second channel and into or out of the first channel, respectively. The
(Continued)

drive system is at least partially disposable in the third channel and configured to drive forward and rearward movements of the piston.

18 Claims, 6 Drawing Sheets

(51) Int. Cl.
*F04D 27/00* (2006.01)
*F04D 29/063* (2006.01)

(52) U.S. Cl.
CPC ..... *F04D 27/002* (2013.01); *F04D 29/063* (2013.01); *F05D 2250/90* (2013.01)

(56) References Cited

U.S. PATENT DOCUMENTS 3,853,433 A * 12/1974 Roberts ..... F04D 27/0246 417/423.13
4,219,305 A 8/1980 Kirtland et al.
4,378,194 A * 3/1983 Bandukwalla ..... F04D 27/0246 415/49
4,460,310 A 7/1984 Plunkett
4,503,684 A * 3/1985 Mount ..... F04D 27/0246 415/14
4,527,949 A 7/1985 Kirtland
4,611,969 A 9/1986 Zinsmeyer
4,616,483 A 10/1986 Leonard
4,969,798 A * 11/1990 Sakai ..... F04D 27/0246 415/150
6,139,262 A 10/2000 Ravidranath
6,857,845 B2 2/2005 Stabley et al.
6,872,050 B2 3/2005 Nenstiel
7,326,027 B1 2/2008 Skoch et al.
7,356,999 B2 4/2008 Bodell, II et al.
8,337,144 B2 12/2012 Stabley et al.
9,212,667 B2 12/2015 Sun et al.
9,810,228 B2 11/2017 Sun et al.
9,874,226 B2 1/2018 Fukuyama
10,330,105 B2 * 6/2019 Gonzalez ..... H01F 7/064
2004/0109757 A1 6/2004 Nenstiel
2014/0328667 A1 11/2014 Sommer et al.
2016/0208809 A1 7/2016 Gonzalez

OTHER PUBLICATIONS

Written OpinionApplication No. PCT/2019/026559; dated Jun. 19, 2019; pp. 10.

* cited by examiner

VARIABLE DIFFUSER DRIVE SYSTEM

CROSS-REFERENCE TO RELATED APPLICATIONS

This application is a National Phase of PCT Application No. PCT/US2019/026559 filed Apr. 9, 2019, which claims the benefit of Chinese Application No. 201810314031.2 filed Apr. 9, 2018, the disclosure of which is incorporated herein by reference in its entirety.

BACKGROUND

The following description relates to heat exchanger systems and, more specifically, to heat exchanger systems with a variable diffuser drive system.

Heat exchanger systems often employ centrifugal compressors to compress fluids as part of a vapor-compression cycle. The centrifugal compressors include diffusers through which compressed fluids flow. Such centrifugal compressor diffusers exhibit certain issues at various operational loads. For example, when part-load conditions are in effect, centrifugal compressor diffusers can be noisy and have high vibratory moments. On the other hand, when full-load conditions are in effect, centrifugal compressor diffusers may be relatively inefficient due to having a narrow working envelope. In addition, centrifugal compressors and their drive systems can be complex.

BRIEF DESCRIPTION

According to an aspect of the disclosure, a system is provided and includes compressor. The compressor further includes a diffuser frame, a gas or oil actuator and a drive system. The diffuser frame defines a first channel through which compressed fluids are flowable, a second channel intersecting the first channel and a third channel extending from the second channel. The gas or oil actuator includes a piston and a head integrally coupled to the piston. The head and the piston are disposable in the second and third channels, respectively. The piston is movable in forward or reverse directions through the third channel such that the head is movable through the second channel and into or out of the first channel, respectively. The drive system is at least partially disposable in the third channel and configured to drive forward and rearward movements of the piston.

In accordance with additional or alternative embodiments, the compressor is fluidly interposed between a cooler and a condenser.

In accordance with additional or alternative embodiments, the compressor is receptive of lubrication from a pump, including a pump outlet, and an oil sump of a lubrication system.

In accordance with additional or alternative embodiments, the drive system is characterized in that the third channel is fluidly communicative with the cooler and the condenser and the oil sump and the pump outlet.

In accordance with additional or alternative embodiments, the gas or oil actuator includes multiple pistons.

In accordance with additional or alternative embodiments, the drive system is re-configurable during operations thereof.

In accordance with additional or alternative embodiments, the drive system includes a motor disposable in the third channel.

In accordance with additional or alternative embodiments, the first and second channels are annular, the third channel is axial, plural in number and arranged at multiple, evenly distributed annular locations and the head includes an annular body.

In accordance with additional or alternative embodiments, the drive system comprises a position sensor disposed within the second channel, the position sensor configured to sense a position of the head and a control element configured to control the drive system in accordance with a sensing of the position of the head by the position sensor.

According to an aspect of the disclosure, a centrifugal compressor is provided with variable diffusion and includes a centrifugal compressor impeller, a gas or oil actuator disposed downstream from the centrifugal compressor impeller and including a piston and a head integrally coupled to the piston, a diffuser frame in which the centrifugal compressor impeller is rotatably disposable and a drive system. The diffuser frame defines a first channel through which compressed fluids flow from the centrifugal compressor impeller, a second channel in which the head is disposable and which intersects with the first channel and a third channel in which the piston is disposable and which extends from the second channel. The drive system is at least partially disposable in the third channel to drive movements of the piston toward and away from positions at which the head at least partially blocks the first channel.

In accordance with additional or alternative embodiments, the drive system is receptive of pressurized fluids.

In accordance with additional or alternative embodiments, the gas or oil actuator includes multiple pistons.

In accordance with additional or alternative embodiments, the drive system is re-configurable during operations thereof.

In accordance with additional or alternative embodiments, the drive system includes a motor disposable in the third channel.

In accordance with additional or alternative embodiments, the first and second channels are annular, the third channel is axial, plural in number and arranged at multiple, evenly distributed annular locations and the head includes an annular body.

In accordance with additional or alternative embodiments, the drive system comprises a position sensor disposed within the second channel and configured to sense a position of the head and a control element configured to control the drive system in accordance with a sensing of the position of the head by the position sensor.

According to an aspect of the disclosure, a method of operating a variable diffuser drive system of a centrifugal compressor is provided. The centrifugal compressor includes a diffuser frame that defines a first channel through which compressed fluids flow, a second channel in which a gas or oil actuator head is disposable and which intersects with the first channel and a plurality of third channels in which at least one gas or oil actuator piston, to which the head is integrally coupled, is disposable and which extend from the second channel. The method includes determining a load condition of the centrifugal compressor and driving forward and reverse movements of the at least one piston in the third channel toward and away from positions at which the head at least partially blocks the first channel in accordance with the load condition.

In accordance with additional or alternative embodiments, the driving includes driving the movements of the at least one piston in concert.

In accordance with additional or alternative embodiments, the driving includes at least one of hydraulic driving and motorized driving.

In accordance with additional or alternative embodiments, the driving includes re-configuring a drive system at least partially disposed in the third channel.

These and other advantages and features will become more apparent from the following description taken in conjunction with the drawings.

BRIEF DESCRIPTION OF THE DRAWINGS

The subject matter, which is regarded as the disclosure, is particularly pointed out and distinctly claimed in the claims at the conclusion of the specification. The foregoing and other features and advantages of the disclosure are apparent from the following detailed description taken in conjunction with the accompanying drawings in which:

These and other advantages and features will become more apparent from the following description taken in conjunction with the drawings.

DETAILED DESCRIPTION

As will be described below, a variable diffuser drive system is provided and configured to move a piston into different positions directly using high pressure refrigerant from a condenser, high pressure oil from an oil pump or linear motor actuation.

Figure 1:
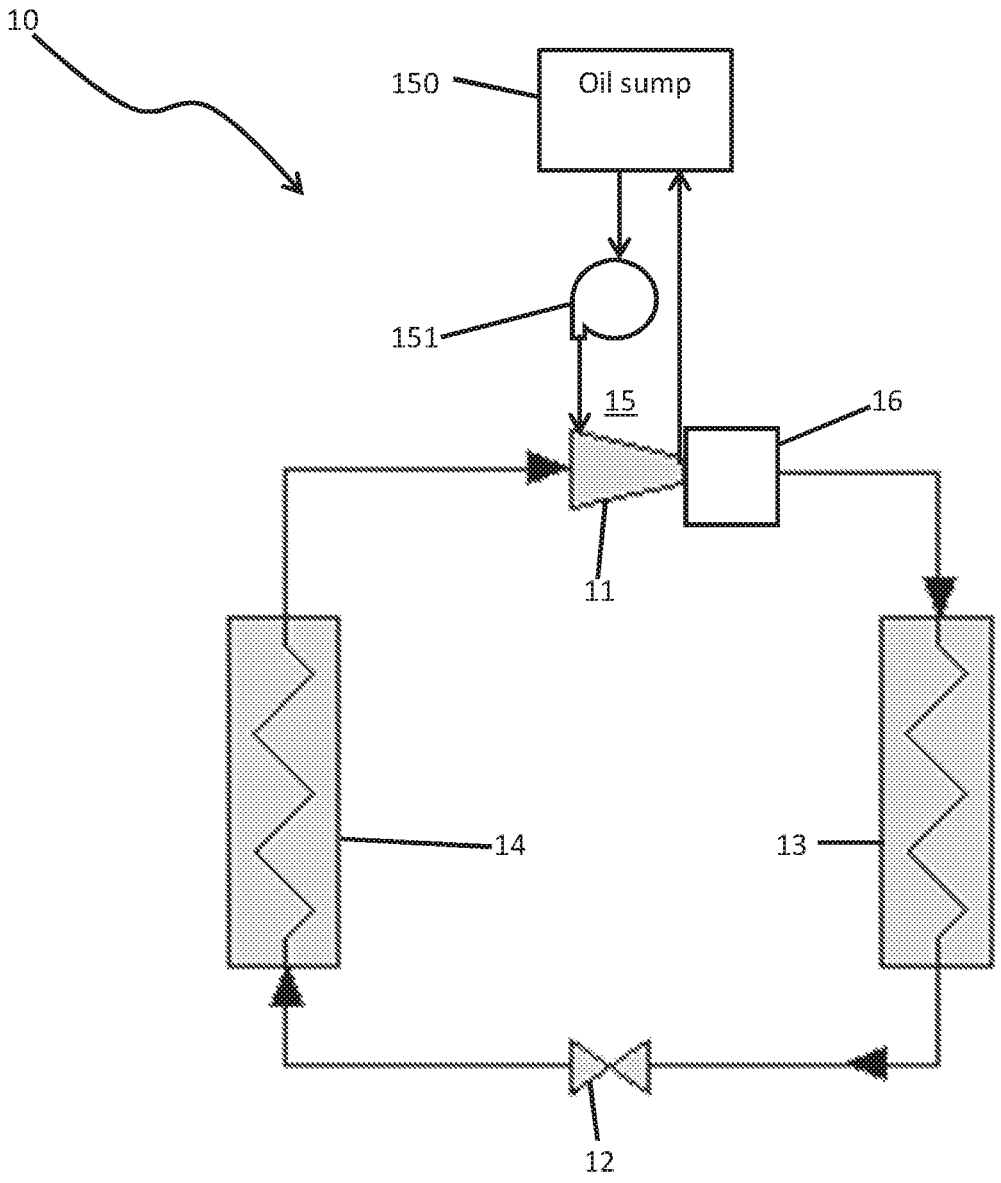
FIG. 1 is a schematic diagram of a heat exchanger system in accordance with embodiments.

With reference to FIG. 1, a heat exchanger system 10 is provided. The heat exchanger system 10 includes a compressor 11, an expansion valve 12, a condenser 13 fluidly interposed between the compressor 11 and the expansion valve 12 and an evaporator or cooler 14 fluidly interposed between the expansion valve 12 and the compressor 11. The compressor 11 is operable to compress a saturated vapor therein and to output a high-pressure and high-temperature superheated vapor toward the condenser 13. The condenser 13 causes the superheated vapor received from the compressor 11 to condense through thermal transfer with water, for example. The condenser 13 outputs the resulting condensed liquid toward the expansion valve 12 as a saturated liquid. The expansion valve 12 abruptly reduced a pressure of the saturated liquid and produces a relatively cold mixture. The liquid of this cold mixture is then evaporated in the cooler 14 through thermal interactions with warm air blown over the cooler 14 and the resulting saturated vapor is returned to the compressor 11.

The compressor 11 may include or be provided as a centrifugal compressor that operates by compressing fluids as a result of a rotation of the compressor 11 about a longitudinal axis thereof. Such rotation can be supported by bearings at opposite ends of the compressor 11, which receive lubrication from a lubrication system 15. The lubrication system 15 includes an oil sump 150 and a pump 151, which pumps pressurized oil from the oil sump 150, through the bearings and back to the oil sump 150.

With continued reference to FIG. 1 and with additional reference to FIGS. 2-5, the heat exchanger system 10 may also include a diffuser 16 at an outlet of the compressor 11 and upstream from the condenser 13. The diffuser 16 converts kinetic energy (i.e., high velocity) of the gas flowing through it into pressure by gradually slowing or diffusing the gas velocity. Diffusers can be vaneless, vaned or an alternating combination thereof.

Figure 2:
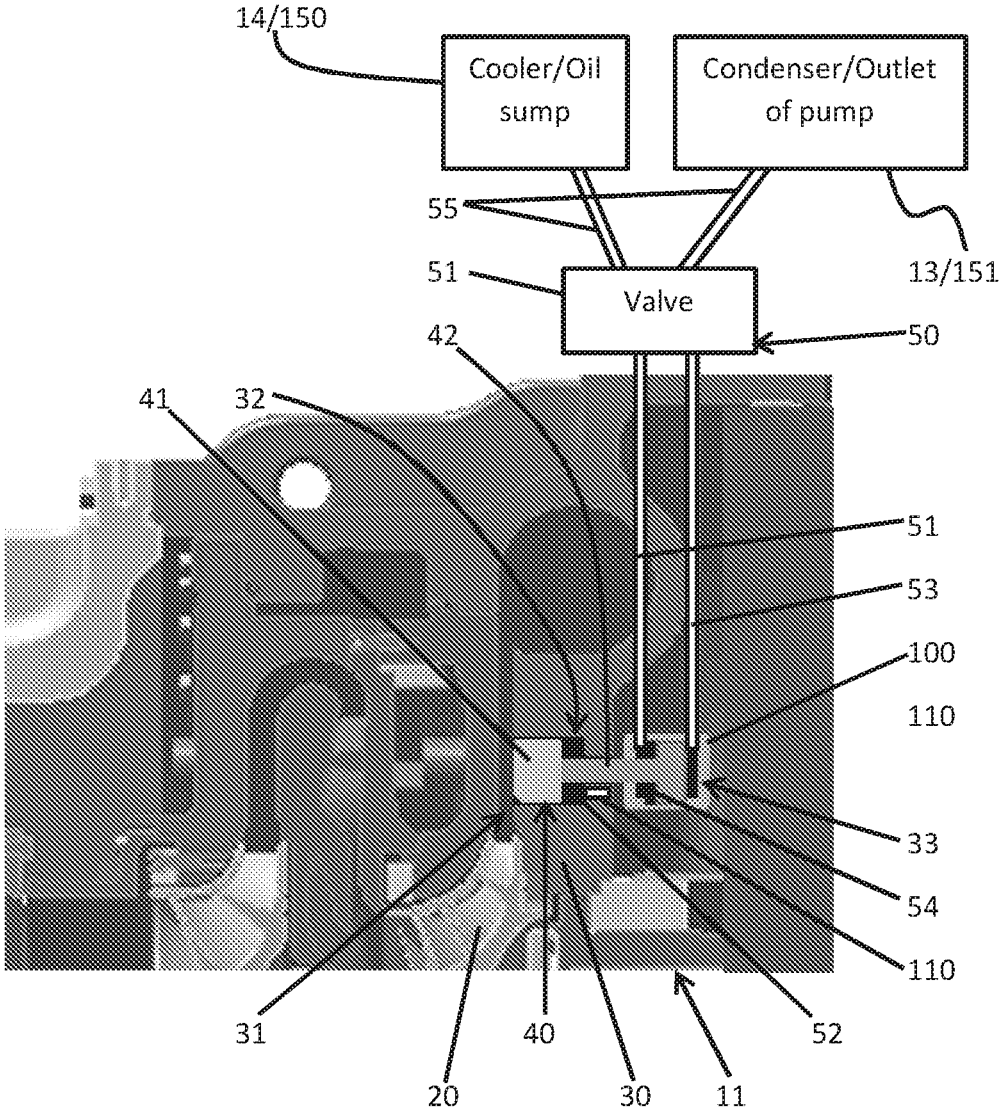
FIG. 2 is a side cutaway view of a variable diffusion drive system of a centrifugal compressor in accordance with embodiments.
Figure 3:
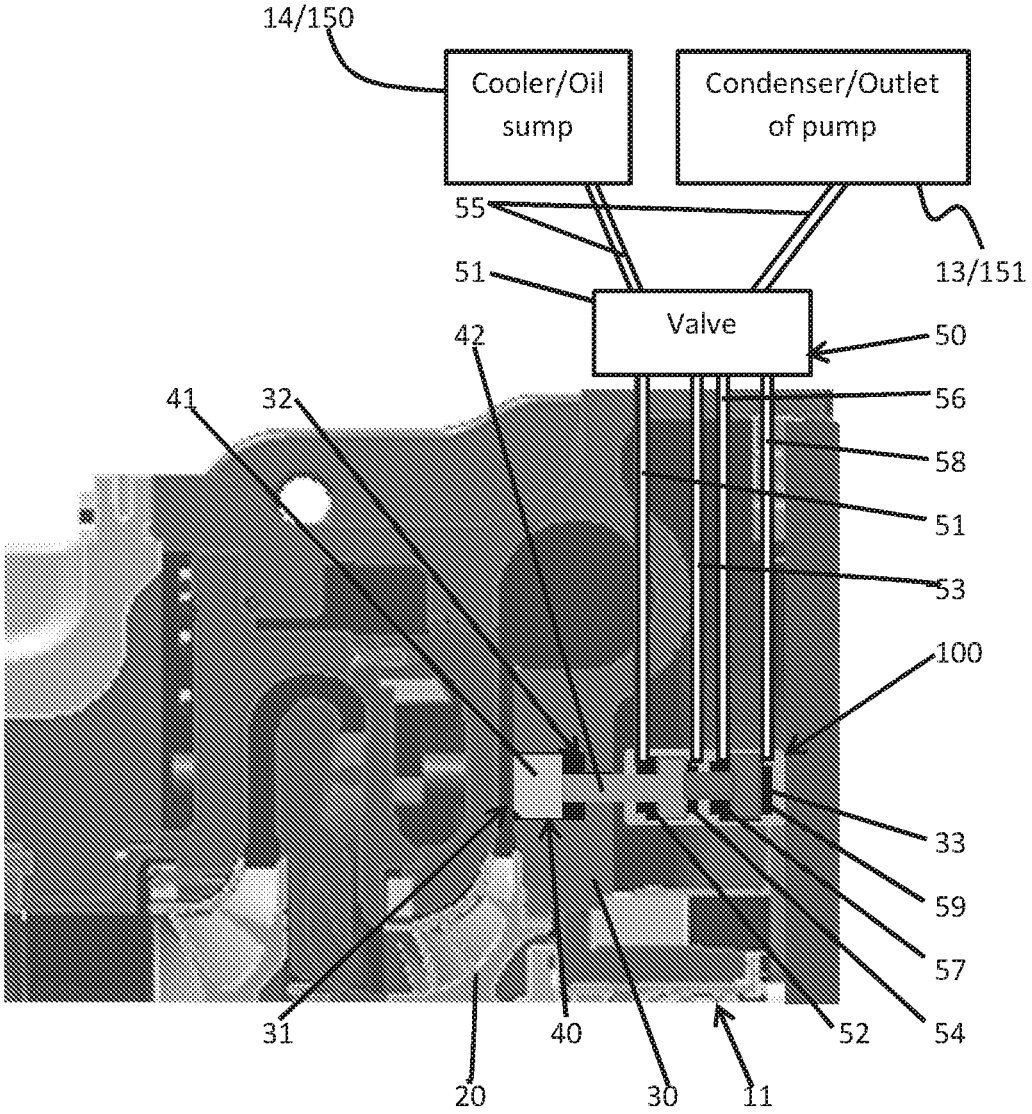
FIG. 3 is a side cutaway view of a variable diffusion drive system of a centrifugal compressor in accordance with further embodiments.
Figure 4:
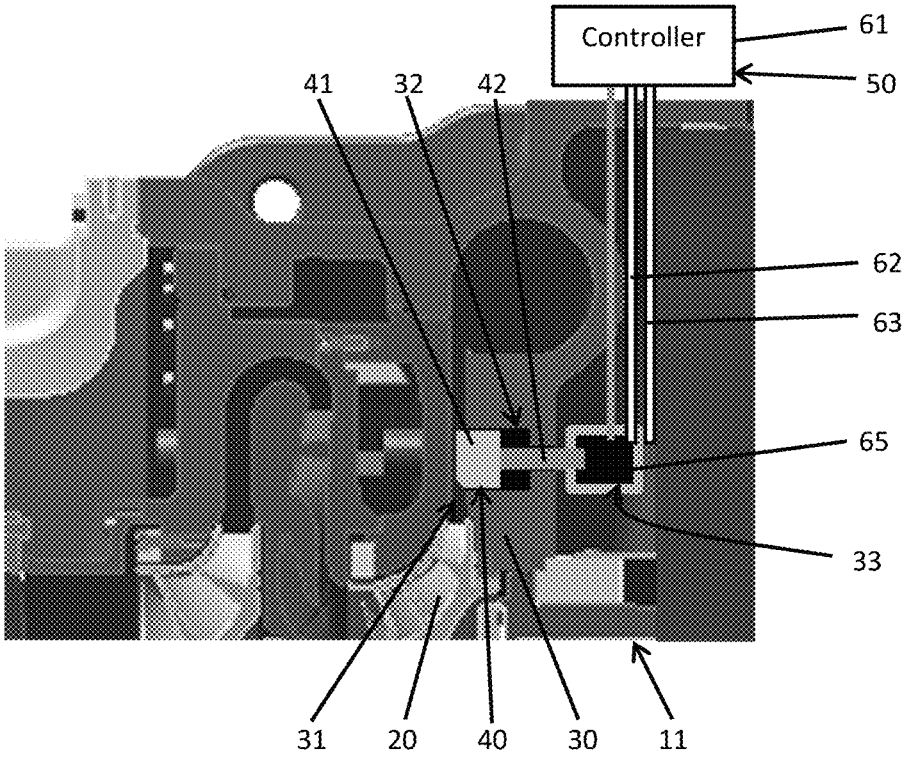
FIG. 4 is a side cutaway view of a variable diffusion drive system of a centrifugal compressor in accordance with alternative embodiments.

In greater detail, as shown in FIGS. 2-4, where the compressor 11 is a centrifugal compressor, for example, the compressor 11 includes a centrifugal compressor impeller 20 and a diffuser frame 30. The centrifugal compressor 20 is rotatably disposable within or adjacent to the diffuser frame 30. The diffuser frame 30 is formed to define a first channel 31 through which compressed fluids flow from the centrifugal compressor impeller 20, a second channel 32 and a third channel 33.

Figure 5:
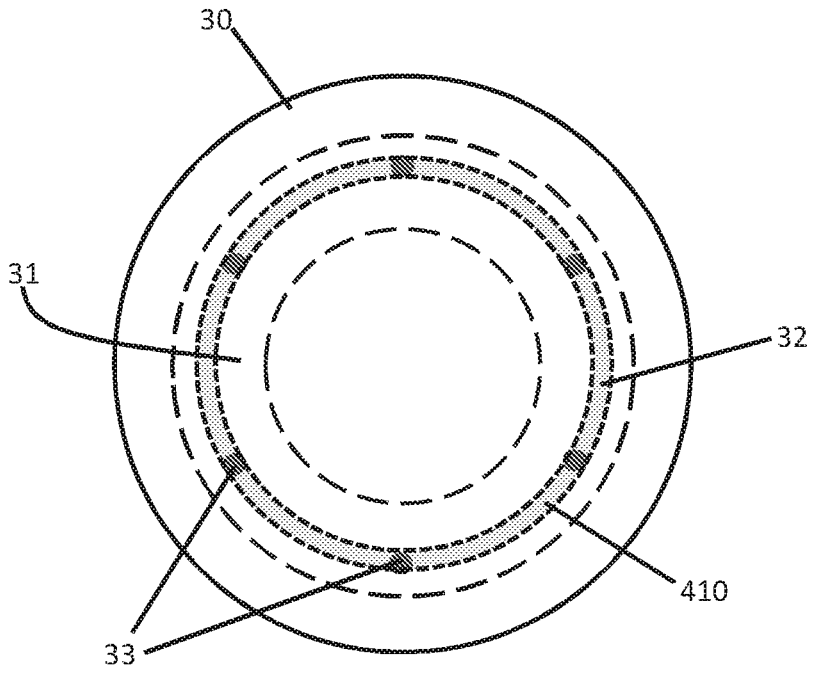
FIG. 5 is a schematic axial view of a diffuser of a centrifugal compressor in accordance with embodiments.

As shown in FIG. 5, the first channel 31 is annular and extends about the longitudinal axis of the compressor 11 and outwardly in a radial direction from an outward-most extent of the centrifugal compressor impeller 20. The second channel 32 intersects with the first channel 31 and is similarly annular and extends about the longitudinal axis of the compressor 11. The second channel 32 also extends axially in an aft direction from a mid-point of the first channel 31. The third channel 33 is oriented axially and is provided as plural third channels 33 that each extend axially in the aft direction from an end of the second channel 32. The plural third channels 33 are distributed substantially evenly along the annularity of the second channel 32.

With continued reference to FIGS. 2-4, the compressor 11 is provided with a variable diffuser drive system 100 that offers variable diffusion capability and includes a gas or oil actuator 40 as well as a drive system 50. The gas or oil actuator 40 is downstream from the centrifugal compressor impeller 20 and includes a head 41 and a piston 42 to which the head 41 is integrally coupled. The head 41 is movable within the second channel 32 and into and out of the first channel 31 to at least partially block a flow of fluids through the first channel 31. The piston 42 is disposable within the third channel 33 and is movable in forward and reverse directions. When the piston 42 moves in the forward direction, the piston 42 urges the head 41 forward and into a blocking condition with respect to the first channel 31. Conversely, when the piston 42 moves in the reverse direction, the piston 42 urges the head 41 to also move in the reverse direction and out of the blocking condition with respect to the first channel 31. The drive system 50 is at least partially disposable in the third channel 33 and is configured to drive movements of the piston 42 toward and away from positions at which the head 41 opens the first channel 31 (e.g., a diffuser full-open position) or at which the head 41 at least partially blocks the first channel 31 (e.g., a diffuser full-closed position).

In accordance with embodiments, the head 41 is ring-shaped and includes an annular body 410 (see FIG. 5). The piston 42 may be provided as plural pistons 42 that are respectively disposable in corresponding ones of the third channels 33.

With the configuration of the first, second and third channels 31, 32 and 33 and with the construction of the gas or oil actuator 40 and the drive system 50, the variable diffusion capability of the compressor 11 is such that the movement of the head 41 into the first channel 31 can be controlled in accordance with various conditions, such as, but not limited to, full-load and part-load conditions.

In accordance with exemplary embodiments and, as shown in FIG. 2, the drive system 50 may be characterized in that the third channel 33 is fluidly communicative with at least one of the cooler 14 and the condenser 13 (see FIG. 1) and with the oil sump 150 and an outlet of the pump 151 (see FIG. 1). The drive system 50 therefore may include: a controllable valve element 51, first piping 52 between the controllable valve element 51 and a first hydraulic chamber 53 of the third channel 33, and second piping 54 between the controllable valve element 51 and a second hydraulic chamber 55 of the third channel 33. The drive system 50 may also include additional piping 56 between the controllable valve element 51 and the cooler 14 and the condenser 13 or between the controllable valve element 51 and the oil sump 150 and the outlet of the pump 151.

In the case of the additional piping 56 extending between each of the controllable valve elements 51 and the cooler 14 and the condenser 13, the controllable valve elements 51 may be operable such that the diffuser full-open and the diffuser full-closed positions are achievable.

For example, at 75%/100% load capacity conditions, the controllable valve elements 51 can be operated or configured such that the first hydraulic chambers 53 are fluidly communicative with the condenser 13 and the second hydraulic chambers 55 are fluidly communicative with the cooler 14. This arrangement causes the pistons 42 to move in the reverse or rearward direction and thus urges the head 41 to retract in the reverse or rearward direction from the first channel 31 toward the diffuser full-open position. Meanwhile, at part load conditions, the controllable valve elements 51 can be re-configured during operational conditions and then operated or configured such that the first hydraulic chambers 53 are fluidly communicative with the cooler 14 and the second hydraulic chambers 55 are fluidly communicative with the condenser 13. This arrangement causes the pistons 42 to move in the forward direction and thus urges the head 41 to move into the first channel 31 toward the diffuser full-closed position.

In the case of the additional piping 56 extending between each of the controllable valve elements 51 and the oil sump 150 and the outlet of the pump 151, the controllable valve elements 51 may be operable such that the diffuser full-open and the diffuser full-closed positions are achievable.

For example, at 75%/100% load capacity conditions, the controllable valve elements 51 can be operated or configured such that the first hydraulic chambers 53 are fluidly communicative with the outlet of the pump 151 and the second hydraulic chambers 55 are fluidly communicative with the oil sump 150. This arrangement causes the pistons 42 to move in the reverse or rearward direction and thus urges the head 41 to retract in the reverse or rearward direction from the first channel 31 toward the diffuser full-open position. Meanwhile, at part load conditions, the controllable valve elements 51 can be re-configured during operational conditions and then operated or configured such that the first hydraulic chambers 53 are fluidly communicative with the oil sump 150 and the second hydraulic chambers 55 are fluidly communicative with the outlet of the pump 151. This arrangement causes the pistons 42 to move in the forward direction and thus urges the head 41 to move into the first channel 31 toward the diffuser full-closed position.

In accordance with exemplary embodiments and, as shown in FIG. 3, the pistons 42 may each be provided as multiple pistons 42 with the drive system 50 being characterized in that the third channel 33 is fluidly communicative with at least one of the cooler 14 and the condenser 13 (see FIG. 1) and with the oil sump 150 and an outlet of the pump 151 (see FIG. 1). The drive system 50 therefore may include: the controllable valve element 51, first piping 52 between the controllable valve element 51 and a first hydraulic chamber 53 of the third channel 33, second piping 54 between the controllable valve element 51 and a second hydraulic chamber 55 of the third channel 33, third piping 57 between the controllable valve element 51 and a third hydraulic chamber 58 of the third channel 33, and fourth piping 59 between the controllable valve element 51 and a fourth hydraulic chamber 60 of the third channel 33. The drive system 50 may also include the additional piping 56 between the controllable valve element 51 and the cooler 14 and the condenser 13 or between the controllable valve element 51 and the oil sump 150 and the outlet of the pump 151.

In the case of the additional piping 56 extending between each of the controllable valve elements 51 and the cooler 14 and the condenser 13, the controllable valve elements 51 may be operable such that the diffuser full-open and the diffuser full-closed positions are achievable.

For example, at 75%/100% load capacity conditions, the controllable valve elements 51 can be operated or configured such that the first hydraulic chambers 53 are fluidly communicative with the condenser 13 and the second, third and fourth hydraulic chambers 55, 58 and 60 are fluidly communicative with the cooler 14. This arrangement causes the pistons 42 to move in the reverse or rearward direction and thus urges the head 41 to retract in the reverse or rearward direction from the first channel 31 toward the diffuser full-open position. Meanwhile, at 50% load capacity conditions, the controllable valve elements 51 can be re-configured during operational conditions and then operated or configured such that the first, second and third hydraulic chambers 53, 55 and 58 are fluidly communicative with the cooler 14 and the fourth hydraulic chambers 60 are fluidly communicative with the condenser 13. This arrangement causes the pistons 42 to move in the forward direction and thus urges the head 41 to move into the first channel 31 toward a diffuser partial-closed position. At part load or 25% load capacity conditions, the controllable valve elements 51 can be re-configured during operational conditions and then operated or configured such that only the second hydraulic chambers 55 are fluidly communicative with the condenser 13 and the first, third and fourth hydraulic chambers 53, 58 and 60 are fluidly communicative with the cooler 14. This arrangement causes the pistons 42 to move in the forward direction and thus urges the head 41 to move into the first channel 31 toward a diffuser full-closed position.

In accordance with exemplary embodiments and, as shown in FIG. 4, the drive system 50 may include motors 65 that are respectively disposable in each of the third channels 33. These motors 65 may be provided, for example, as linear motor actuators. They are each receptive of power and signal data from a controller 66 by way of wired or wireless communication lines 67 and 68 and are configured to apply a motorized drive to the pistons 42 as described herein.

In accordance with further embodiments and, as shown in FIG. 2 the variable diffuser drive system 100 may also include a position sensor 110 (it is to be understood that the position sensor 110 can be provided in any of the embodiments described herein and is included only in FIG. 2 for illustrative purposes). The position sensor 110 can be disposed and configured to sense a position of the annular body 410 (see FIG. 5) of the head 41 so that the sensed position can be employed in a feedback control loop that allows for greater control over operations of the variable diffuser drive system 100.

Figure 6:
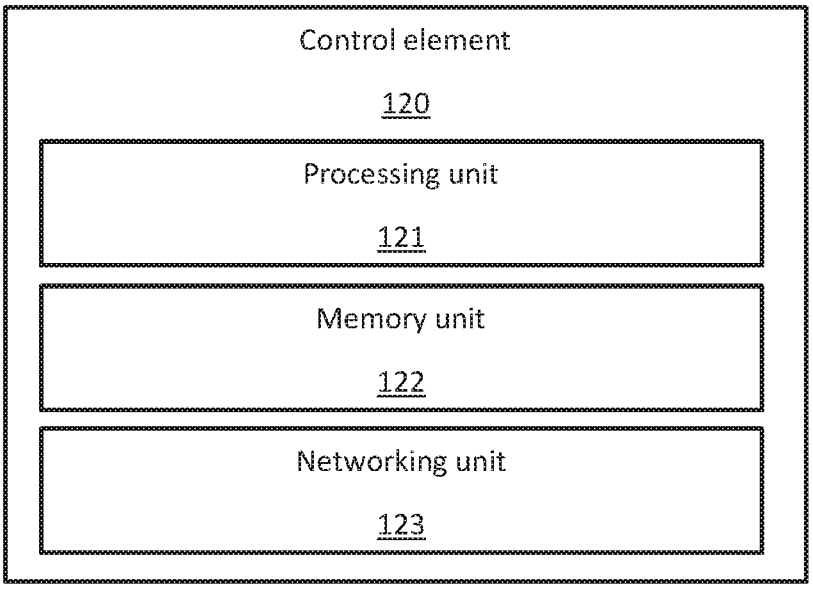
FIG. 6 is a schematic diagram of a control element of a variable diffuser drive system in accordance with embodiments.

That is, with reference to FIG. 6, the variable diffuser drive system 100 may also include a control element 120 that is disposed in signal communication with the position sensor 110 and with the controllable valve elements 51 of FIGS. 2 and 3 or with the controller 61 of FIG. 4. As shown in FIG. 6, the control element 120 may include a processing unit 121, a memory unit 122 and a networking unit 123 by which the processing unit 121 is communicative with the position sensor 100 and the controllable valve element 51 or the controller 61. The memory unit 122 has executable instructions stored thereon, which are readable and executable by the processing unit 121. When the executable instructions are read and executed by the processing unit 121, the executable instructions cause the processing unit 121 to operate as described herein.

Figure 7:
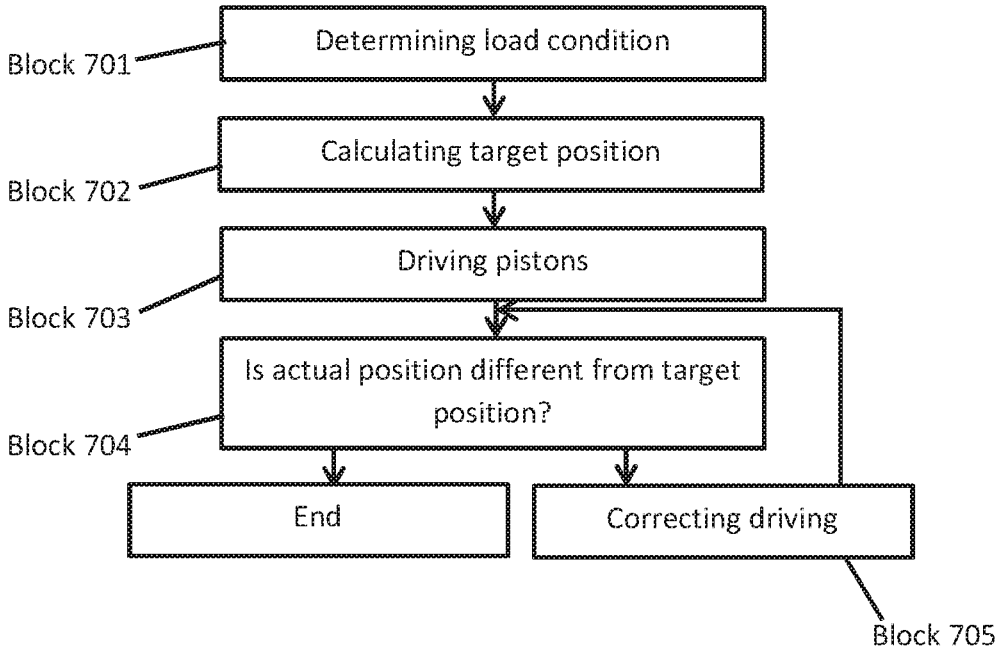
FIG. 7 is a flow diagram illustrating a method of operating a variable diffusion drive system in accordance with embodiments.

With reference to FIG. 7, a method of operating the variable diffuser drive system 100 described herein is provided. The method includes determining a load condition of the centrifugal compressor (block 701), calculating a target position of the head 41 of the gas or oil actuator 40 to achieve a certain degree of variable diffusion for the determined load condition (block 702) and configuring or reconfiguring the drive system 50 to drive (e.g., by hydraulic or motorized driving) forward and reverse movements of the pistons 42 in the third channels 33 in concert with one another toward and away from positions at which the head 41 at least partially blocks the first channel 31 in accordance with the determined load condition (block 703). The method further includes sensing an amount of diffusion achieved by the driving of block 703 and determining an actual position of the head 41 of the gas or oil actuator 40 or sensing an actual displacement of the head 41 of the gas or oil actuator 40 by the position sensor 110 of FIG. 1 (block 704) and correcting the driving to an extent that the actual position of the head 41 differs from the target position (block 705).

Benefits of the features described above are a reduced number of components and increased simplicity with lowered costs as well as increased reliability and simplified design.

While the disclosure is provided in detail in connection with only a limited number of embodiments, it should be readily understood that the disclosure is not limited to such disclosed embodiments. Rather, the disclosure can be modified to incorporate any number of variations, alterations, substitutions or equivalent arrangements not heretofore described, but which are commensurate with the spirit and scope of the disclosure. Additionally, while various embodiments of the disclosure have been described, it is to be understood that the exemplary embodiment(s) may include only some of the described exemplary aspects. Accordingly, the disclosure is not to be seen as limited by the foregoing description, but is only limited by the scope of the appended claims.

What is claimed is:

1. A system comprising:

a compressor further comprising:

a diffuser frame defining a first channel through which compressed fluids are flowable, a second channel intersecting the first channel and a third channel extending from the second channel;

a gas or oil actuator comprising a piston and a head integrally coupled to the piston, the head and the piston being disposable in the second and third channels, respectively, and the piston being movable in forward or reverse directions through the third channel such that the head is movable through the second channel and into or out of the first channel, respectively; and a drive system at least partially disposable in the third channel and configured to drive forward and rearward movements of the piston, wherein:

the first and second channels are annular, the third channel is axial, plural in number and arranged at multiple, evenly distributed annular locations, and the head comprises an annular body.

2. The system according to claim 1, wherein the compressor is fluidly interposed between a cooler and a condenser.

3. The system according to claim 2, wherein the compressor is receptive of lubrication from a pump, including a pump outlet, and an oil sump of a lubrication system.

4. The system according to claim 3, wherein the drive system is characterized in that the third channel is fluidly communicative with at least one of:

the cooler and the condenser; and the oil sump and the pump outlet.

5. The system according to claim 1, wherein the gas or oil actuator comprises multiple pistons.

6. The system according to claim 1, wherein the drive system is re-configurable during operations thereof.

7. The system according to claim 1, wherein the drive system comprises a motor disposable in the third channel.

8. The system according to claim 1, wherein the drive system comprises a position sensor disposed within the second channel, the position sensor configured to sense a position of the head; and a control element configured to control the drive system in accordance with a sensing of the position of the head by the position sensor.

9. A centrifugal compressor with variable diffusion, comprising:

a centrifugal compressor impeller;

a gas or oil actuator disposed downstream from the centrifugal compressor impeller and comprising a piston and a head integrally coupled to the piston;

a diffuser frame in which the centrifugal compressor impeller is rotatably disposable, the diffuser frame defining:

a first channel through which compressed fluids flow from the centrifugal compressor impeller, a second channel in which the head is disposable and which intersects with the first channel, and a third channel in which the piston is disposable and which extends from the second channel; and a drive system at least partially disposable in the third channel to drive movements of the piston toward and away from positions at which the head at least partially blocks the first channel, wherein:

the first and second channels are annular, the third channel is axial, plural in number and arranged at multiple, evenly distributed annular locations, and the head comprises an annular body.

10. The centrifugal compressor according to claim 9, wherein the drive system is receptive of pressurized fluids.

11. The centrifugal compressor according to claim 9, wherein the gas or oil actuator comprises multiple pistons.

12. The centrifugal compressor according to claim 9, wherein the drive system is re-configurable during operations thereof.

13. The centrifugal compressor according to claim 9, wherein the drive system comprises a motor disposable in the third channel.

14. The centrifugal compressor according to claim 9, wherein the drive system comprises:

a position sensor disposed in the second channel, the position sensor configured to sense a position of the head; and a control element configured to control the drive system in accordance with a sensing of the position of the head by the position sensor.

15. A method of operating a variable diffuser drive system of a centrifugal compressor including a diffuser frame that defines a first channel through which compressed fluids flow, a second channel in which a gas or oil actuator head is disposable and which intersects with the first channel and a plurality of third channels in which at least one gas or oil actuator piston, to which the head is integrally coupled, is disposable and which extend from the second channel, the method comprising:

determining a load condition of the centrifugal compressor; and driving forward and reverse movements of the at least one piston in the third channel toward and away from positions at which the head at least partially blocks the first channel in accordance with the load condition.

16. The method according to claim 15, wherein the driving comprises driving the movements of the at least one piston in concert.

17. The method according to claim 15, wherein the driving comprises at least one of hydraulic driving and motorized driving.

18. The method according to claim 15, wherein the driving comprises re-configuring a drive system at least partially disposed in the third channel.

* * * * *